US011219326B1

(12) United States Patent
Gutierrez

(10) Patent No.: US 11,219,326 B1
(45) Date of Patent: Jan. 11, 2022

(54) LUNCH BOX WITH INTERNAL CHILLER AND TEMPERATURE MONITOR

(71) Applicant: John Gutierrez, Mandeville, LA (US)

(72) Inventor: John Gutierrez, Mandeville, LA (US)

( * ) Notice: Subject to any disclaimer, the term of this patent is extended or adjusted under 35 U.S.C. 154(b) by 0 days.

(21) Appl. No.: 16/375,741

(22) Filed: Apr. 4, 2019

Related U.S. Application Data

(60) Provisional application No. 62/652,371, filed on Apr. 4, 2018.

(51) Int. Cl.

| | |
|---|---|
| ***A47G 23/04*** | (2006.01) |
| ***A45C 11/20*** | (2006.01) |
| ***A45C 13/02*** | (2006.01) |
| ***A45C 13/00*** | (2006.01) |
| ***A45C 13/10*** | (2006.01) |

(52) U.S. Cl.

CPC ..... *A47G 23/04* (2013.01); *A45C 11/20* (2013.01); *A45C 13/001* (2013.01); *A45C 13/02* (2013.01); *A45C 13/10* (2013.01); *A47G 2200/066* (2013.01); *A47G 2200/166* (2013.01)

(58) Field of Classification Search

CPC ..... A45C 11/20; A45C 13/001; A45C 13/02; A45C 13/10; A47G 2200/066; A47G 2200/116

USPC ..... 206/545; 220/592.01–592.03, 220/592.12–592.14, 592.2, 915.1; 62/457.1–457.9

See application file for complete search history.

(56) References Cited

U.S. PATENT DOCUMENTS

| | | | | | |
|---|---|---|---|---|---|
| 2,187,387 | A * | 1/1940 | Trigg | F25C 1/24 | 62/466 |
| 2,339,580 | A * | 1/1944 | Park | A45C 11/20 | 206/544 |
| 2,457,043 | A * | 12/1948 | Histand | A45C 11/20 | 220/592.2 |
| 2,505,405 | A * | 4/1950 | Jarboe | A45C 11/20 | 219/387 |
| 3,807,194 | A * | 4/1974 | Bond | A47G 23/04 | 62/457.4 |
| 4,240,271 | A * | 12/1980 | Brownlow | A47G 23/04 | 206/259 |
| 5,658,314 | A * | 8/1997 | Scheffer | A61J 17/001 | 606/235 |
| 5,758,513 | A * | 6/1998 | Smith | A45C 11/20 | 62/457.5 |
| 5,975,334 | A * | 11/1999 | Mayo | A45C 11/20 | 220/4.27 |
| 7,178,673 | B1 * | 2/2007 | Miller | F25D 3/08 | 206/545 |
| 7,240,513 | B1 * | 7/2007 | Conforti | A45C 13/02 | 62/457.2 |

(Continued)

*Primary Examiner* — Chun Hoi Cheung
(74) *Attorney, Agent, or Firm* — Kenneth L. Tolar

(57) ABSTRACT

A lunch box includes a housing having a bottom surface, a front wall, a rear wall, two opposing sidewalls and an open top in communication with an interior storage chamber. A pivotal lid encloses the open top to provide selective access to the interior storage chamber. A freeze pack and an accessory tray seamlessly fit within the interior storage chamber. The tray houses a sensor that measures temperature, pressure and humidity within the interior chamber, and transmits the measured data to a portable electronic device. Therefore, a remote user can monitor the condition of the storage chamber without opening the lid or otherwise accessing the lunch box.

15 Claims, 5 Drawing Sheets

(56) References Cited

U.S. PATENT DOCUMENTS

| | | | | |
|---|---|---|---|---|
| 10,443,918 | B2 * | 10/2019 | Li | B65D 25/06 |
| 2004/0045781 | A1 * | 3/2004 | Scicluna | A45C 13/42<br>190/110 |
| 2005/0205459 | A1 * | 9/2005 | Mogil | A45C 11/20<br>206/545 |
| 2007/0028642 | A1 * | 2/2007 | Glade | F25D 3/06<br>62/371 |
| 2009/0045204 | A1 * | 2/2009 | Marganski | A45C 11/20<br>220/592.03 |
| 2012/0132657 | A1 * | 5/2012 | Seiders | B65D 81/3816<br>220/592.2 |
| 2013/0062356 | A1 * | 3/2013 | Deka | F25D 3/08<br>220/592.25 |
| 2015/0375918 | A1 * | 12/2015 | Holderness | B65D 83/00<br>222/566 |
| 2016/0135626 | A1 * | 5/2016 | Pfeiffer | A61B 5/1118<br>206/459.1 |
| 2017/0305605 | A1 * | 10/2017 | Sonntag | B65D 81/3823 |
| 2017/0305638 | A1 * | 10/2017 | Sonntag | B65D 43/22 |
| 2018/0186547 | A1 * | 7/2018 | Morine | F25D 3/08 |

* cited by examiner

LUNCH BOX WITH INTERNAL CHILLER AND TEMPERATURE MONITOR

CROSS REFERENCE TO RELATED APPLICATIONS

This application is entitled to the benefit of provisional patent application No. 62/652,371 filed on Apr. 4, 2018, the specification of which is incorporated herein by reference.

BACKGROUND OF THE INVENTION

The present invention relates to a lunch box having an internal chiller and a wireless temperature sensor for storing perishables in a cool, controlled and monitored environment.

DESCRIPTION OF THE PRIOR ART

Lunch boxes are regularly used to transport food and beverages to a remote location for later consumption. If a user also wishes to transport a chilled beverage or perishable food, a separate insulated container, such as a cooler or ice chest, is required, which is burdensome and inconvenient. Alternatively, the chilled beverage can be transported and stored in the lunch box, where it quickly warms to ambient temperature. Placing ice or a freezable gel pack in a lunch box is rarely an option. Most conventional lunch boxes have limited storage space and melting ice leaks onto the contents and a surrounding area.

Moreover, having a practical means for chilling the interior storage chamber of a lunch box would allow a user to also conveniently transport and preserve perishable medications and other personal items. However, certain medications and beverages, such as wine or milk, should be maintained in a climate-controlled environment to prevent spoilage. Even if a chilled storage container is available, a user often ignores it once distracted with other activities. Eventually, someone returns to the storage container to discover that the ice has melted and that the contents are unacceptably warm or spoiled.

Accordingly, there is currently a need for a lunch box that allows a user to conveniently transport beverage containers, food items and medications in a chilled environment and to readily verify the temperature to determine if corrective action is required. The present invention addresses this need by providing a lunch box having a uniquely designed freeze pack, a storage tray for delicate items, a wireless temperature sensor and a bottle rack.

SUMMARY OF THE INVENTION

A lunch box includes a housing having a bottom surface, a front wall, a rear wall, two opposing sidewalls and an open top in communication with an interior storage chamber. A pivotal lid encloses the open top to provide selective access to the interior storage chamber. A freeze pack and an accessory tray seamlessly fit within the interior storage chamber. The tray removably houses a sensor that measures temperature, pressure and humidity within the interior chamber, and transmits the measured data to a portable electronic device. Therefore, a remote user can monitor the condition of the storage chamber without opening the lid or otherwise accessing the lunch box.

It is therefore an object of the present invention to provide a lunch box having a sensor in wireless communication with an electronic device for instantly determining ambient conditions within an interior food-storage chamber.

It is another object of the present invention to provide a lunch box having a uniquely designed storage tray for safely retaining delicate medications and food items.

It is yet another object of the present invention to provide a lunch box having a uniquely designed freeze pack that seamlessly fits within the food storage chamber to preserve stored contents within a chilled environment.

Other objects, features, and advantages of the present invention will become readily apparent from the following detailed description of the preferred embodiment when considered with the attached drawings and the appended claims.

DESCRIPTION OF THE PREFERRED EMBODIMENT

Figure 1:
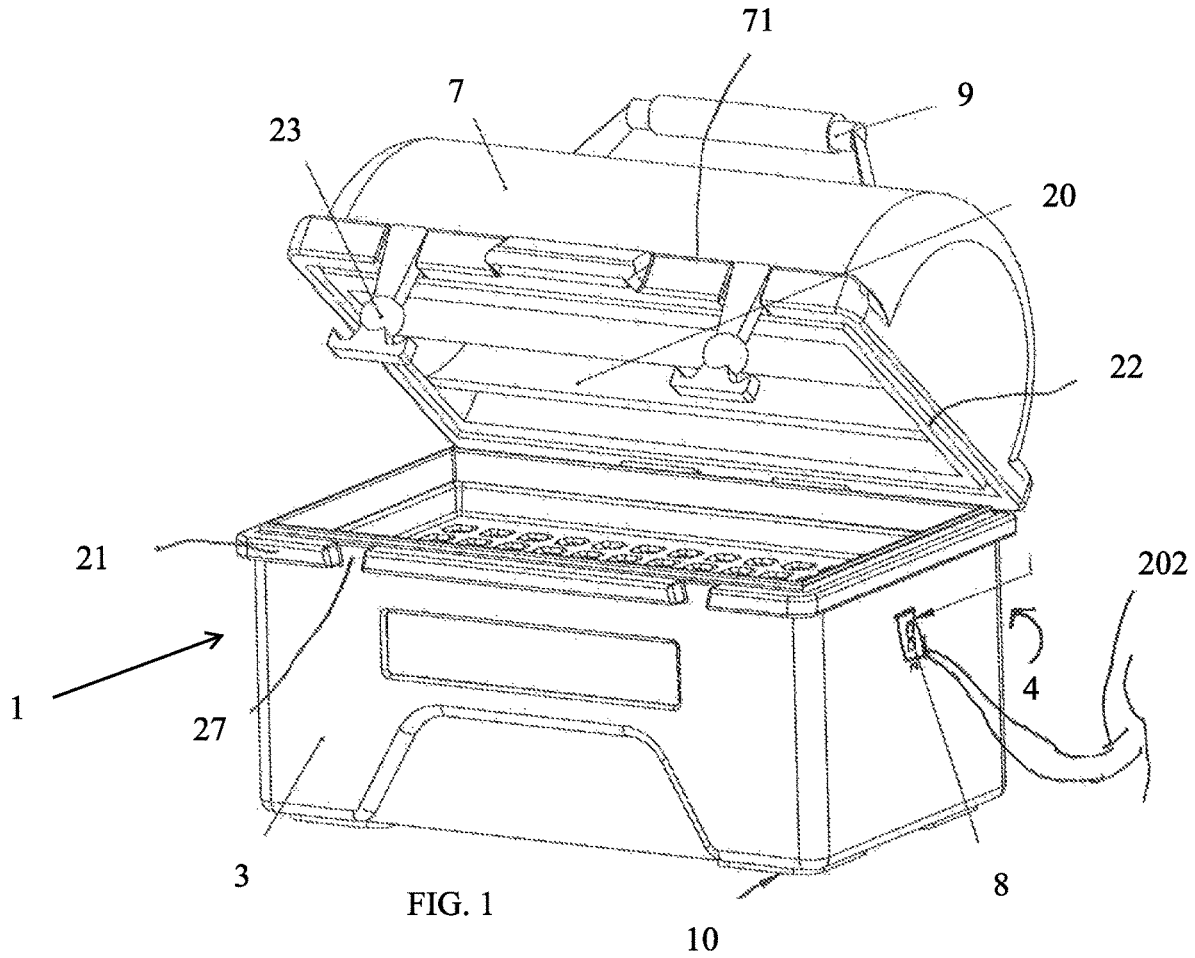
FIG. 1 is a perspective view of the lunch box according to the present invention, with the lid in a partially opened position.
Figure 2:
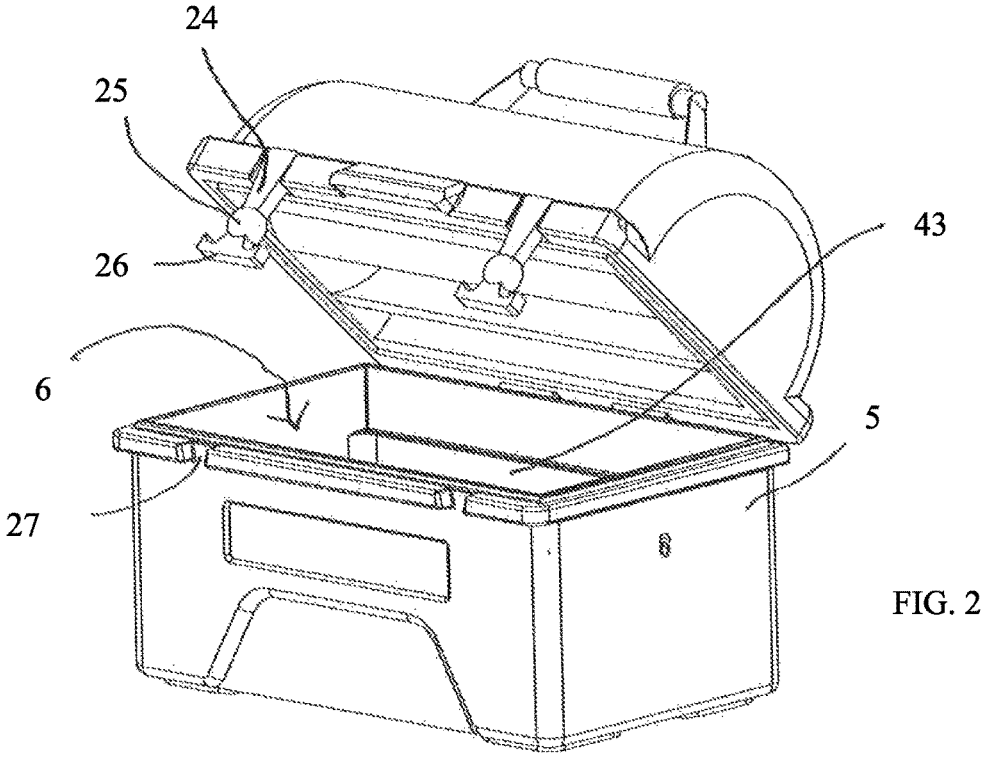
FIG. 2 is a perspective view of the lunch box of FIG. 1 with the tray removed.
Figure 4:
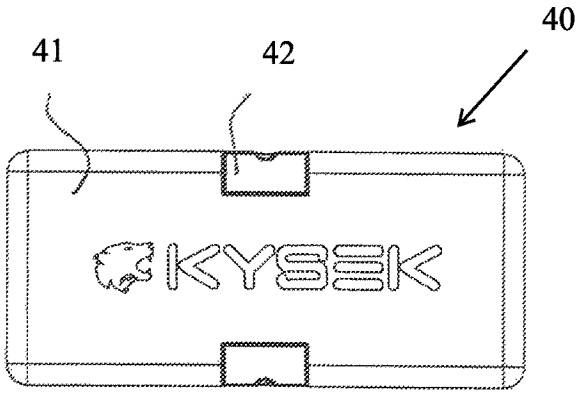
FIG. 4 is an isolated view of the freeze pack.
Figure 6:
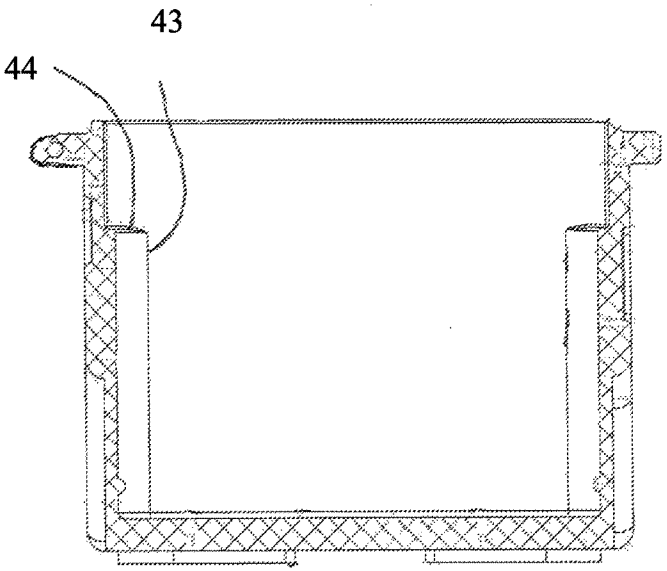
FIG. 6 is a cross-sectional view of the housing taken along A-A of FIG. 5.
Figure 3:
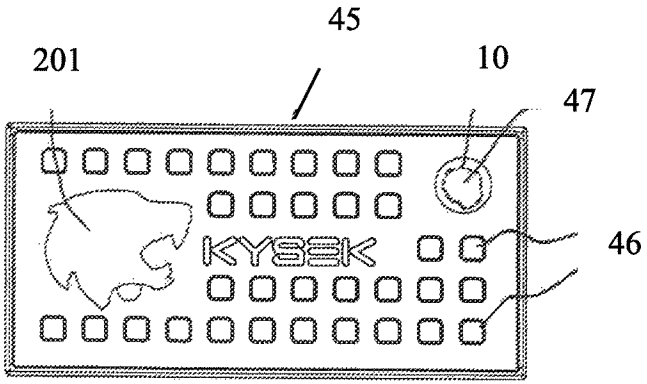
FIG. 3 is an isolated view of the storage tray.
Figure 5:
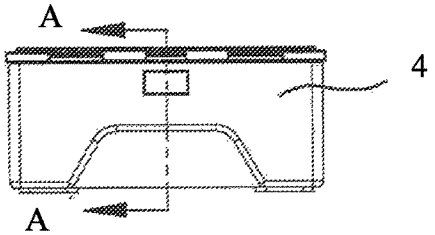
FIG. 5 is an isolated, front view of the housing.
Figure 8:
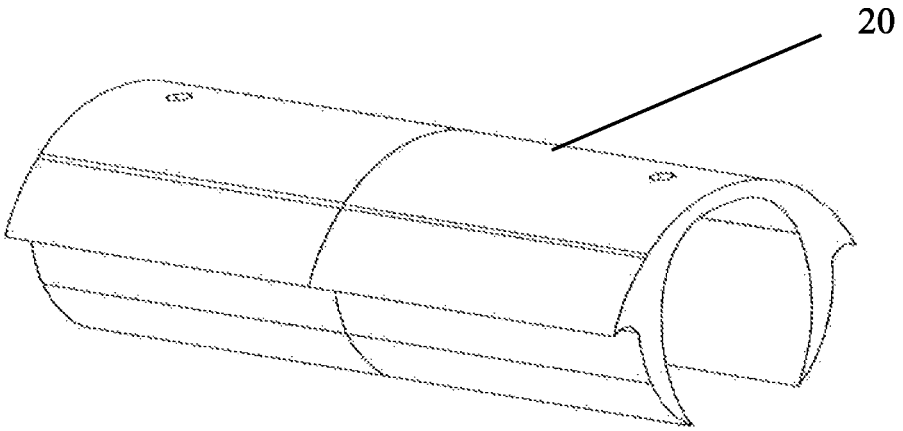
FIG. 8 is an isolated view of the beverage holder.
Figure 7:
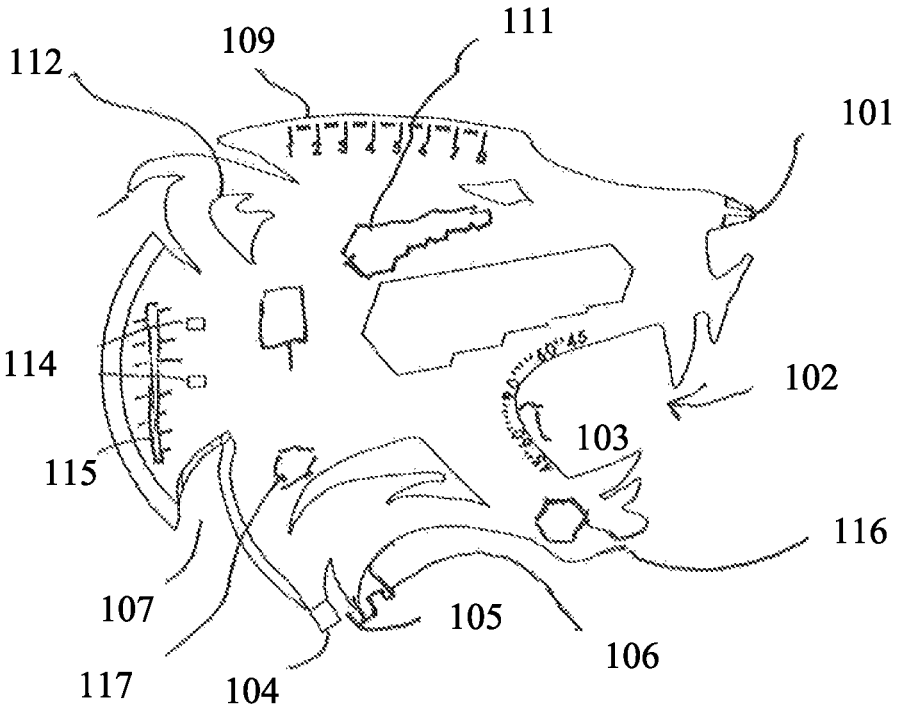
FIG. 7 is an isolated, plan view of the versatile tool.
Figure 9:
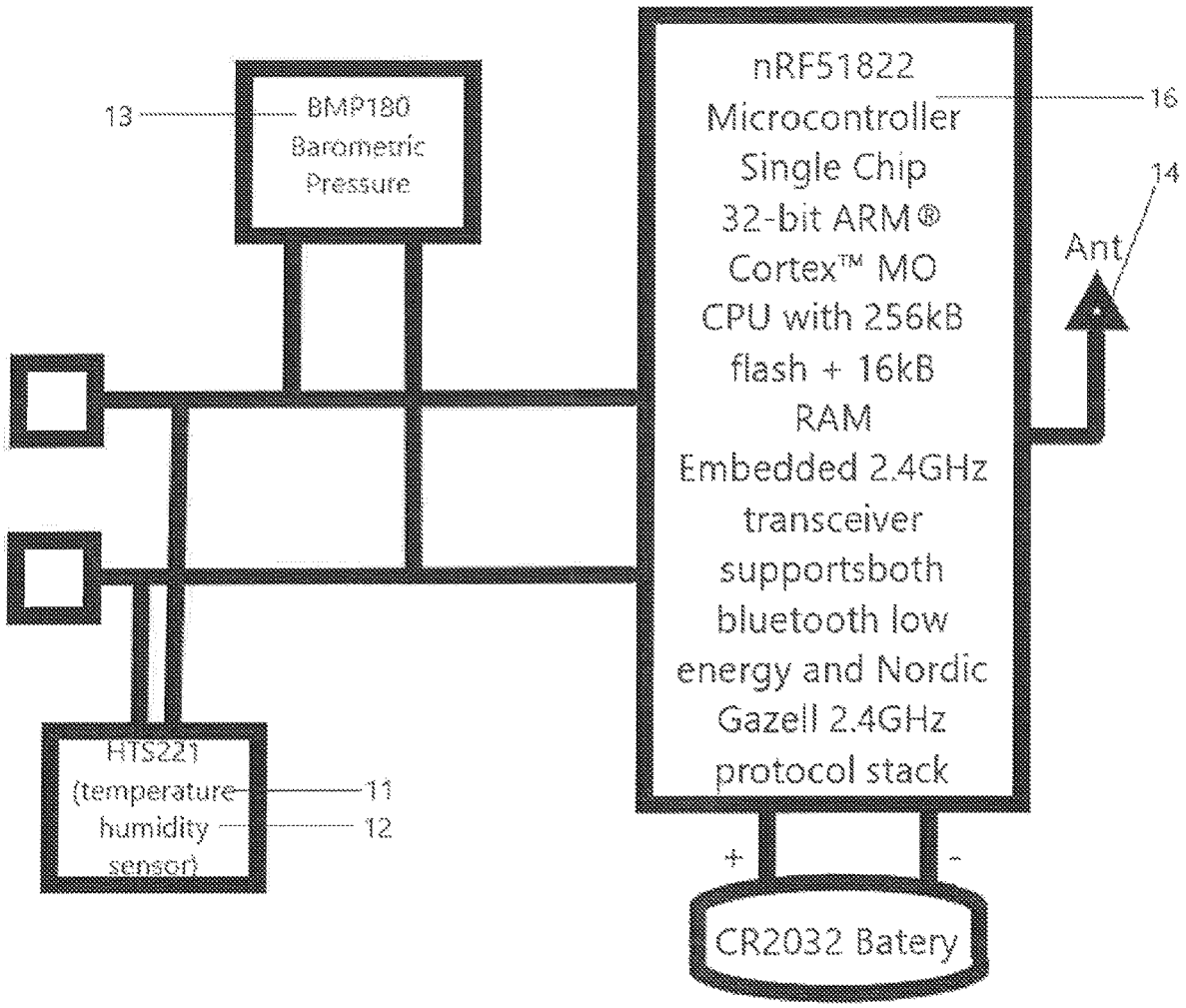
FIG. 9 is a block diagram of the sensor circuit.

The present invention relates to a lunch box comprising a housing 1 having a bottom surface 2, a front wall 3, a rear wall 4, two opposing sidewalls 5 and an open top in communication with an interior storage chamber 6. Hingedly attached to an upper edge of the rear wall is a lid 7 that selectively encloses the open top to provide access to the interior storage chamber. On each sidewall is a D-buckle 8 for removably securing a shoulder strap 202 to the housing while the lid includes a handle 9 that a user grasps when transporting the device. Footpads 10 on the bottom wall prevent the housing from sliding on an underlying surface.

A semi-cylindrical sleeve 20 on the lower surface of the lid firmly retains beverage containers, such as a wine bottle or a thermos. The sleeve is constructed with a resilient but pliable material to expand and contract around varying-diameter and varying-shaped containers.

The open upper end is surrounded by a continuous rim 21 that mates with a similar rim 22 on a lower edge of the lid when the lid is closed. Depending from a free, front edge 71 of the lid are a pair of latch members 23, each including an elongated, elastomeric stem 24 having a ball 25 and a T-shaped handle 26 at a distal end. The latch member 23 is pivoted downwardly to a vertical position, the stem 24 is stretched and the ball 25 is thrust beneath a designated notch 27 formed on the upper rim 21 of the housing to secure the lid in a closed position.

The lunch box further includes a freeze pack 40 formed of a casing 41 having a low-freeze-point refrigerant within the interior that cools to a frigid temperature when placed within a freezer. Due to the low thermal conductivity of the casing material, the refrigerant also remains at the frigid temperature longer when removed from the freezer to chill stored items for an extended period of time. The casing is dimensioned to overlay the entire bottom surface of the housing with its peripheral edges abutting the interior walls. Accordingly, the casing includes a pair of opposing finger indentations 42 that assist a user with separating the casing from the bottom surface when removing the freeze pack.

In the preferred embodiment, the refrigerant is carboxymethylcellulose (CMC), which has a low degradation rate and, therefore, has a longer useful life. Furthermore, CMC has minimal penetration capability relative to the shell material so that an initial supply of the refrigerant will remain after numerous freeze cycles. Finally, CMC is completely non-toxic to humans if inadvertently ingested. However, the type of refrigerant can be varied and could include any of those currently used in freezable gel packs.

Attached to the inner surfaces of both the front wall and rear wall is a panel 43 that terminates immediately below the open upper end of the housing to form a ledge 44. Removably supportable on the ledge is a tray 45 for retaining fragile food items, perishable medications and other vulnerable personal items that might otherwise be damaged by the other stored contents. The tray includes rows and columns of apertures 46 that allow condensation, melting ice (if used) or other liquids to harmlessly drain onto the bottom surface of the housing. Furthermore, the apertures provide retainers for uprightly storing certain medical items. For example, the autoinjector marketed and sold under the registered trademark EpiPen® can be inserted into an aperture, with the injection needle and medication extending toward the freeze pack below to assure proper temperature maintenance.

The tray further includes a circular cavity 47 that removably receives a sensor 10 for measuring various atmospheric parameters within the storage chamber. The sensor includes a disk-shaped housing having a temperature sensor 11, a humidity sensor 12 and a barometer therein 13, each in communication with a wireless transmitter 14, such as that commonly marketed and sold under the trademark Bluetooth™. The transmitter is in discrete wireless communication with a select portable electronic device 15 having a specialized application thereon. The portable electronic device can be a smart phone, a tablet computer, a smart watch or a similar device. By opening the application, a carrier of the portable electronic device can view the current temperature, relative humidity and pressure within the interior storage chamber, and other data as explained in more detail below.

The sensor further includes a microcontroller 16 that initiates transmission of data and various alerts to the portable electronic device. For example, the user receives an alert if the temperature within the interior chamber is above a preselected threshold so that the user can quickly return to replace the freeze pack.

Figure 10:
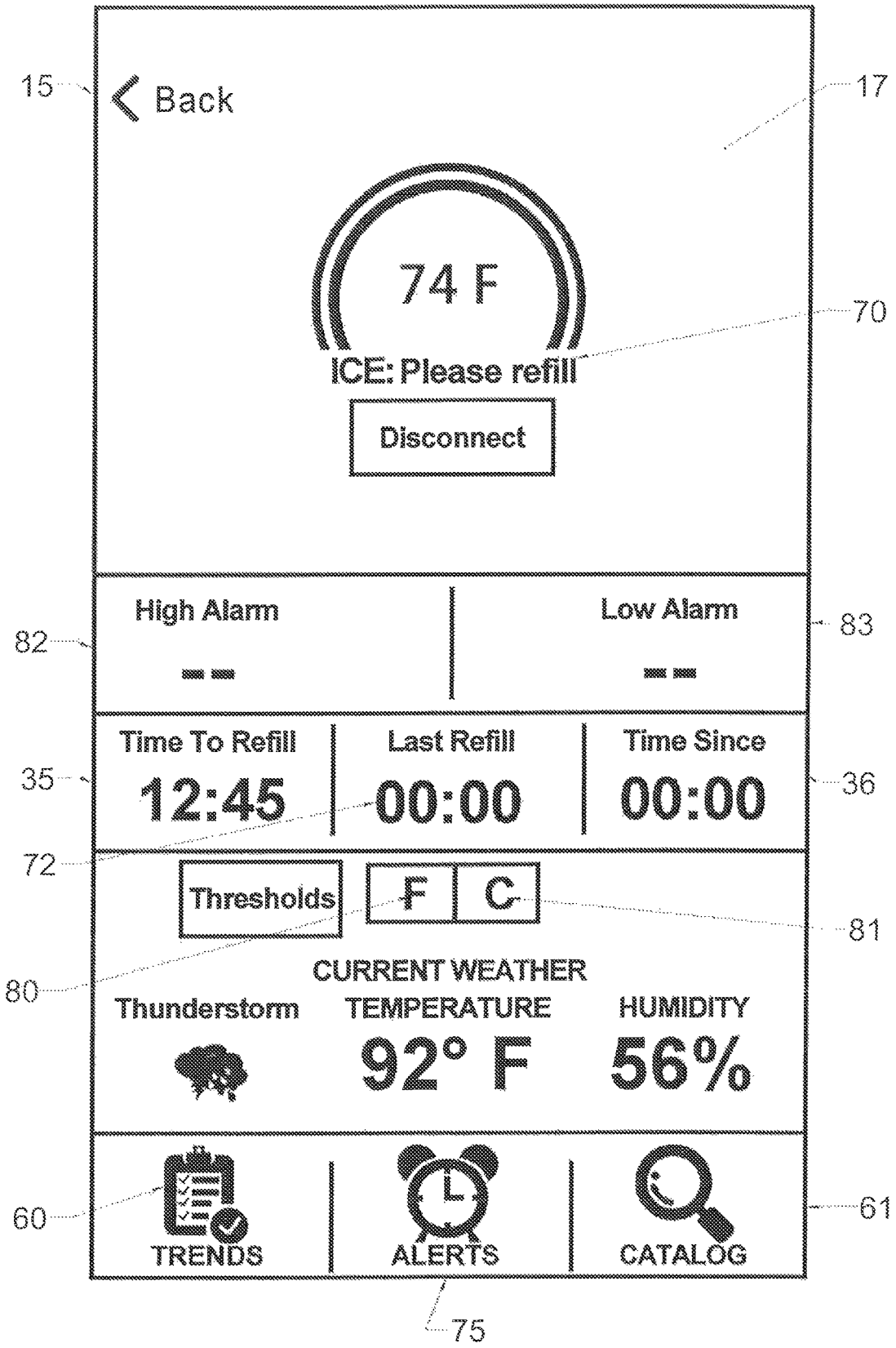
FIG. 10 is a plan view of a portable electronic device depicting the pertinent sensor data.

Referring specifically now to FIG. 10, when opened, the application will generate a home screen 17 on the electronic device where a user can view measured data and other conditions. For example, the user can readily determine the current temperature within the storage chamber and a freeze pack condition identifier 70, such as "please replace." The screen automatically depicts other informational data, such as an estimated remaining life 35 of the freeze pack, a time of a previous replacement 72 and an elapsed time 36 since a last replacement. A "trend" button 60 allows a user to generate charts for a given parameter and a "catalogue" button 61 allows the user to review all historical data. An "alert" button 75 generates a list of all prior alarm events. Other buttons allow a user to designate temperature units, i.e., ° F. or ° C. 80, 81, and high 82 and low-temperature 83 alarm thresholds. The application also interacts with the electronic device's GPS and other third-party applications to display current weather conditions in the area.

The tray further includes a receptacle 201 that receives a uniquely designed tool. The tool is shaped into a logo or another design element and includes various tools, such as but not limited to:

a. a phillips-head screwdriver 101;
b. a bottle opener 102;
c. a protractor 103;
d. a flathead screwdriver 104;
e. a nail set 105;
f. a valve-stem tool 106;
g. a line cutter 107;
h. a pick 108;
i. ruler 109;
j. standard wrenches 110;
k. metric wrenches 111; 1. a keychain hole 112;
m. an oxygen wrench 113;
n. a money-clip attachment 114;
o. a slot rule 115;
p. wrench 116;
q. wrench 117.

As is readily apparent from the detailed description above, the present invention provides a new and improved lunch box that can be easily monitored from a remote location and without opening a lid. Furthermore, the unique sensor can be easily removed its designated cavity and repaired, replaced or inspected with minimal effort.

The housing, tray and freeze-pack casing are preferably constructed with food-grade, high-density polyethylene (HDPE) or a similar minimally conductive material. However, the above-described device is not limited to the exact details of construction and enumeration of parts provided herein. For example, though the sensor is primarily depicted and described as measuring temperature, pressure and humidity, virtually any type of ambient parameter can be measured and monitored. Furthermore, the size, shape and materials of construction of the various components can be varied.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

What is claimed is:

1. A lunch box comprising:

a housing having at least one outer wall and an open top in communication with an interior storage chamber;

a pivotal lid superimposed on the open top for providing selective access to the interior storage chamber;

a chilling means within said interior chamber for cooling said interior chamber to allow perishable items to be stored therein;

a storage tray removably suspended within said interior chamber for storing items above said chilling means, said tray having a cavity;

a means for measuring a temperature within the interior storage chamber to monitor said chilling means, wherein said means comprises a sensor housing configured to removably fit within the cavity on said tray, said sensor housing having a temperature sensor, an atmospheric pressure sensor and a humidity sensor therein temperature sensor;

a means for transmitting a temperature measured by said temperature sensor to a remote electronic device.

2. The lunch box according to claim 1 wherein said chilling means includes a casing having a low-freeze-point refrigerant within an interior that cools to a frigid temperature when placed within a freezer.

3. The lunch box according to claim 2 wherein said refrigerant is carboxymethylcellulose.

4. The lunch box according to claim 2 wherein said casing is dimensioned to overlay the entire bottom surface of the housing.

5. The lunch box according to claim 4 wherein said casing includes a pair of opposing finger indentations that assist a user with separating said casing from said bottom surface.

6. The lunch box according to claim 1 wherein said tray further includes a receptacle having a tool received therein.

7. The lunch box according to claim 6 wherein said receptacle and said tool are configured to resemble an ornamental design.

8. The lunch box according to claim 7 wherein said ornamental design includes a plurality of discrete tools.

9. The lunch box according to claim 1 further comprising a semi-cylindrical sleeve on a lower surface of said lid, said sleeve constructed with a resilient but pliable material to expand and contract around varying-diameter beverage containers.

10. The lunch box according to claim 1 further comprising a pair of latch members depending from a free, front edge of said lid, each of said latch members including an elongated, elastomeric stem having a ball and a T-shaped handle at a distal end, whereby each of said latch members is pivoted downwardly to a vertical position, the stem is stretched and the ball is thrust beneath a designated notch formed on said housing to secure the lid in a closed position.

11. The lunch box according to claim 1 further comprising:

a D-buckle on each sidewall;

a shoulder strap removably attachable to the D-buckle on each sidewall.

12. The lunch box according to claim 1 wherein said sensor housing includes a microcontroller that initiates transmission of data and alerts to the portable electronic device.

13. The lunch box according to claim 1 wherein said tray includes rows and columns of apertures that allow liquids to harmlessly drain onto the bottom surface of the housing and for uprightly storing items.

14. The lunch box according to claim 1 wherein said atmospheric pressure sensor and said humidity sensor are in wireless communication with a portable electronic device.

15. The lunch box according to claim 14 wherein said portable electronic device has software in communication with said temperature sensor, said atmospheric pressure sensor, and said humidity sensor that generates a home screen on the electronic device where a user can view measured data.

* * * * *